United States Patent [19]

Sheasby et al.

[11] 4,066,816

[45] Jan. 3, 1978

[54] ELECTROLYTIC COLORING OF ANODIZED ALUMINIUM BY MEANS OF OPTICAL INTERFERENCE EFFECTS

[75] Inventors: Peter Geoffrey Sheasby; Graham Cheetham, both of Banbury, England

[73] Assignee: Alcan Research and Development Limited, Montreal, Canada

[21] Appl. No.: 703,976

[22] Filed: July 9, 1976

[30] Foreign Application Priority Data

July 16, 1975 United Kingdom ..... 29936/75

[51] Int. Cl.[2] ..... C25D 5/00; C25D 5/24; B32B 3/00

[52] U.S. Cl. ..... 428/336; 204/35 N; 204/58; 428/141; 428/403; 428/469

[58] Field of Search ..... 428/141, 143, 144, 148, 428/195, 206, 207, 209, 332, 336, 403, 469, 472, 539; 204/35 N, 38 A, 58, 35.1; 96/27 R

[56] References Cited

U.S. PATENT DOCUMENTS

| | | | |
|---|---|---|---|
| Re. 28,506 | 8/1975 | Quaintance et al. | 428/469 X |
| 3,382,160 | 5/1968 | Asada et al. | 204/35 N |
| 4,013,465 | 3/1977 | Clapham et al. | 96/27 R |

FOREIGN PATENT DOCUMENTS

| | | |
|---|---|---|
| 48-9658 | 3/1973 | Japan. |
| 49-67043 | 6/1974 | Japan. |

OTHER PUBLICATIONS

Wood et al., "The Anodizing of Aluminum in Sulphate Solutions" in Electrochimica Acta. (1970), vol. 15, pp. 1865-1876.

*Primary Examiner*—Thomas J. Herbert, Jr.
*Assistant Examiner*—R. Eugene Varndell, Jr.
*Attorney, Agent, or Firm*—Cooper, Dunham, Clark, Griffin & Moran

[57] ABSTRACT

Anodized aluminium having an anodic oxide film of at least 3 microns thickness is colored by electrolytically depositing inorganic pigment from metallic salt solutions, particularly nickel, cobalt, tin and copper salts and mixtures. The pigment deposits are characterized by outer ends of an average size in excess of 260 A lying at a distance of 500 - 3000 A from the aluminium-/aluminium oxide interface.

In a preferred method of production the anodic oxide coating is formed under conventional anodizing conditions in a sulphuric acid-based electrolyte. The anodized aluminium is then treated in phosphoric acid at a voltage of 8 - 50 volts to enlarge the pores to above 260 A in a region at the base of the pores adjacent the barrier layer. The pigment is then deposited in the pores to the specified depth and interesting new color shades are obtained as a result of optical interference due to the presence of the large size shallow inorganic pigment deposits.

8 Claims, 2 Drawing Figures

Figure 1:
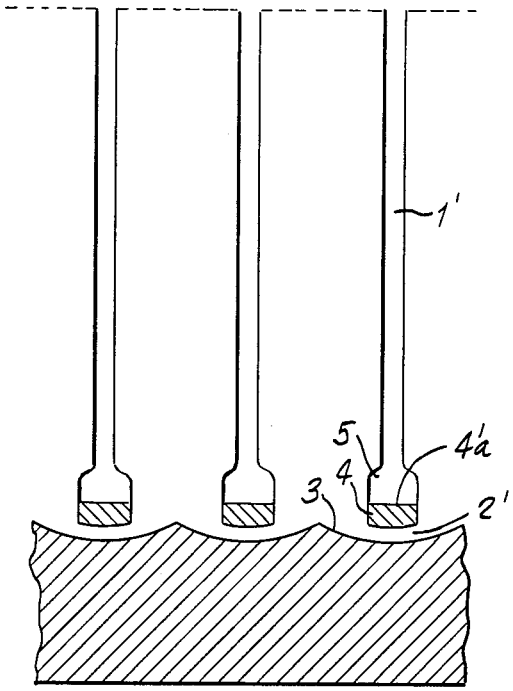

ELECTROLYTIC COLORING OF ANODIZED ALUMINIUM BY MEANS OF OPTICAL INTERFERENCE EFFECTS

The present invention relates to the production of coloured anodic oxide films on aluminium (including aluminium alloys).

The colouring of anodic oxide films by electrolytic deposition of inorganic particles has become well known. In the electrocolouring process inorganic particles are deposited in the pores of the anodic oxide film by the passage of electric current, usually alternating current, between an anodised aluminium surface and a counterelectrode, whilst immersed in an acidic bath of an appropriate metal salt. The most commonly employed electrolytes are salts of nickel, cobalt, tin and copper. The counterelectrode is usually graphite or stainless steel, although nickel, tin and copper electrodes are also employed when the bath contains the salt of the corresponding metal.

The nature of the deposited particles has been the subject of much speculation and it is still uncertain whether the particles are in the form of metal or metallic oxide (or a combination of both). These deposited particles constitute what is referred to herein as inorganic pigmentary deposits.

Using, for example, a nickel sulphate electrolyte the colours obtained range from golden brown through dark bronze to black with increase in treatment time and applied voltage. It would be an obvious advantage to be able to employ a single electrolytic colouring bath to provide a wide range of colours.

It is believed that in the coloured anodic oxide coatings the increasingly dark colours are the result of the increasing amount of light scattering by the deposited particles and consequent absorption of light within the coating. The gold to bronze colours are believed to be due to greater adsorption of the shorter wave length light, i.e. in the blue-violet range. As the pores of the film become filled with deposited particles the extent of the scattering by the particles and absorption of light within the film becomes almost total, so that the film acquires an almost completely black appearance.

In current commercial practice direct-current anodising in a sulphuric acid-based electrolyte has almost totally replaced all other anodising processes for the production of thick, clear, porous-type anodic oxide coatings, such as are employed as protective coatings on aluminium curtain wall panels and window frames, which are exposed to the weather. In general, anodising voltages employed for sulphuric acid-based electrolytes range from 12 to 22 volts depending upon the strength and temperature of the acid. Sulphuric acid-based electrolytes include mixtures of sulphuric acid with other acids, such as oxalic acid and sulphamic acid, in which the anodising characteristics are broadly determined by the sulphuric acid content. Typically in sulphuric acid anodising the electrolyte contains 15–20% (by weight) sulphuric acid at a temperature of 20° C and a voltage of 17–18 volts.

It has been shown (G. C. Wood and J. P. O'Sullivan: Electrochimica Acta 15 1865–76 (1970) that in a porous-type anodic aluminium oxide film the pores are at essentially uniform spacing so that each pore may be considered as the centre of an essentially hexagonal cell. There is a barrier layer of aluminium oxide between the bottom of the pore and the surface of the metal. The pore diameter, cell size and barrier layer thickness each have a virtually linear relationship with the applied voltage. This relationship holds true within quite small deviations for other electrolytes employed in anodising aluminium, form example chromic acid and oxalic acid.

In normal sulphuric acid anodising, the pore diameter is in the range of 150–180 A (Angstrom units) and the applied voltage is 17–18 volts. The barrier layer thickness is about equal to the pore diameter and the cell size is about 450–500 A. The same holds true with mixed sulphuric acid-oxalic acid electrolytes.

As compared with the coloured anodic oxide films mentioned above, the present invention is concerned with coloured anodic films on aluminium where the apparent colour is due to optical interference in addition to the scattering and absorption effects already noted.

Optical interference can occur when a thin film of translucent material is present on the surface of a bulk material which is opaque or of a different refractive index. This results in interference between light reflected from the surface of the thin film and from the surface of the bulk material. The colour seen as a result of this interference is dependent on the separation of these two reflecting surfaces, i.e. on the thickness of the 'thin film'. Constructive interference, in which a particular colour in the spectrum is increased, occurs if the optical path difference is equal to n. $\lambda$, where $\lambda$ is the wavelength of light falling on the surface and $n = 1, 2, 3 \ldots$ etc., and destructive interference, in which a particular colour in the spectrum is diminished, occurs if the optical path difference is equal to $n. \lambda/2$ (n being an odd integer, viz. 1, 3, 5). In the case of the interference effects of this invention it is only the first and, perhaps, second order interference (i.e. $n = 1$ or 2 for constructive interference or $n = 1$ or 3 for destructive interference) that is likely to have any visible effect. The optical path difference is equal to twice the separation multiplied by the refractive index (in the circumstances of the present invention, the refractive index of aluminium oxide which has a value of about 1.6 – 1.7).

Oxide films on aluminium, when grown to a sufficient thickness, can show multi-colour interference effects due to interference between the light reflected from the oxide film surface and light passing through the oxide layer and reflected from the metal surface. Even anodic oxide coatings, if they are sufficiently thin, give rise to interference colours, but such effects are never seen on anodic oxide coatings more than about ½ micron in thickness. Such very thin anodic films on aluminium surfaces, however, have little protective value when exposed to outdoor weathering conditions.

However, we have now found surprisingly, that we can produce a thick anodic oxide coating, with a thickness of above 3 microns, say 15–25 microns or higher, and a relatively small pore size, and then electrolytically deposit pigment particles in the pores in such a way that interference occurs between light scattered from the individual deposit surfaces and light scattered from the aluminium/aluminium oxide interference. The colour then produced depends on the difference in optical path resulting from separation of the two light scattering surfaces as a complement to the colour due to dispersion by the particles. The separation, when colouring a particular film, will depend on the height of the deposited particles. In this way a different range of attractive colours, including blue-grey, yellow-green, orange-brown and purple, can be produced by electrolytic colouring. These colours have very high stability to light and the excellent durability to weathering of a normal anodic finish on aluminium and do not exhibit the irridescent, rainbow-like appearance characteristic of thin films.

The production of the interference colours is dependent on the deposit being of the correct height to obtain interference of light scattered from the deposit surfaces with that scattered at the aluminium/aluminium oxide interface. To obtain colours in the visible range the optical path difference (as earlier defined) should be in the range of about 1700–10,000 A. The separation between the top surfaces of the deposits and the aluminium/aluminium oxide interface should be in the range of about 500–3000 A to provide colours between blue-violet due to destructive interference at the botton of this range to dark green due to second order constructive interference at the top end of the range to complement the normal pale bronze which would result from small deposits obtained in the ordinary electrocolouring process. If the optical path difference is too great, then only the normal bronze or black finishes are produced by the electrocolouring process.

If electrolytic deposition of inorganic particles is carried out in a thick anodic oxide film, produced by anodising in sulphuric acid-based electrolytes under normal voltage conditions (already mentioned above), very little, if any, colouration can be achieved by interference effects. Where the height of the deposits in such films is of the order necessary to provide separation in the range discussed above very little colouration is achieved. However, we have discovered that satisfactory colours can be achieved by optical interference, by particles providing a separation in the above-quoted range, if the size (cross-section) of the individual deposits at their outer ends can be increased. Increase of the size of the deposits can be achieved by increasing the pore diameter of the individual pores at least at the base of the pore adjacent the barrier layer. In order to obtain bright colouration by optical interference effects, it is necessary to provide anodised aluminium in which deposited particles can have outer end surfaces having an average size of at least 260 A at a separation distance from the aluminium/aluminium oxide interface in the range of 500–3000 A. In fact, there is a significant increase in the intensity of the colours as the average particle size is increased from 260 A to 300 A and higher. The production of pores of this size cannot readily be achieved by increase of the applied voltage in a conventional 15–20% sulphuric acid anodising electrolyte, since this would lead to excessive current flow to the workpiece with consequent overheating and damage to the oxide film.

However, pores of the desired size at the appropriate distance from the aluminium/aluminium oxide interface can be developed either by continuing the anodising under special conditions or by a dissolution after-treatment of the oxide film. Where the after-treatment is carried out electrolytically at a voltage a little above the forming voltage of the anodic oxide film, it is probable that the consequent increase in pore size in due to simultaneous dissolution of aluminium oxide and growth of new anodic oxide film.

The process of the present invention may in broad terms be considered as the production of coloured anodised aluminium, by first producing a thick porous oxide film of a thickness of at least 3 microns and preferably 15–30 microns and having an average pore size of below 230 A, then by an after-treatment increasing the average pore size, at least at the base of the pore, to at least 260 A and more preferably to a size in excess of 300 A, and finally electrolytically depositing inorganic material in such pores to a depth sufficient to lead to interference between light scattered from the surfaces of the deposits and light scattered from the aluminium surface at the aluminium oxide/aluminium interface.

The after-treatment is preferably continued until the vertical extent of the enlarged portion of the pores in the region of the barrier layer is at least 3000 A (measured from the aluminium/aluminium oxide interface) to enable the production of a full range of interference colours. However, in many instances such vertical extent may be much smaller, for example in the range of 500–1500 A.

To produce the greatest intensity of colouration the thick porous anodic oxide film is preferably initially formed under conditions which lead to a cell size (pore spacing) typical of conventional sulphuric acid-type films and then the pore size (at least in the critical region of the pore where the surface of the deposited inorganic material will be located) is increased by a post-treatment, which leads to dissolution of the anodic oxide film at the walls of the pores.

Pore enlargement can be achieved in different ways:- a. by selectively dissolving the surfaces of the pores in an existing film (for example a film produced in a sulphuric acid-based electrolyte) by either chemical or electrochemical means. Electrochemical means are preferred since this allows field-assisted dissolution to take place at the base of the pores with the minimum of bulk film dissolution, whilst also permitting control of barrier layer thickness. It usually involves electrolyte temperatures above 20° C and applied voltages similar to or less than the normal sulphuric acid anodising voltages. The selective dissolution is either performed by employing an acid of different chemical composition and/or of different concentration and/or under different electrical conditions and/or temperature conditions than the anodising operation. Where chemical dissolution is employed, the pores are enlarged by treatment with a reagent having strong dissolving power for aluminium oxide. Sulphuric acid, nitric acid, phosphoric acid and sodium hydroxide are examples of such reagents. The treatment time decreases as the strength and/or temperature is increased.

b. by growing a new anodic film at the base of the existing film by using anodising voltages above the normal sulphuric acid anodising voltages. A separate, more widely spaced, but enlarged pore structure develops under the more closely spaced structure of the original anodic film when a high anodising voltage, such as 40 volts, is employed in an electrolyte suitable for producing a porous-type anodic oxide film at such voltage.

c. by a combination of these two mechanisms whereby a voltage slightly above the original anodising voltage is used under anodising conditions which, allows simultaneous selective dissolution together with growth of a new film under the existing film. For example, a voltage of 25 volts is suitable where the original anodising voltage was 17–18 volts.

As explained above, the separation of the outer surface of the deposits from the aluminium/aluminum oxide interface should be of the order of 500–3000 A (0.05 – 0.3 microns). The depth of the deposits is very small as compared with the deposits in the bronze to black films produced in the conventional operation of the abovementioned alternating current process, which are estimated to have a depth of up to 8 microns (commonly 2 to 4 microns). The colouring conditions (including voltage and treatment time) required to give rise to interference colours will depend upon the structure of the anodic film at the end of the post-treatment and particularly on the thickness of the barrier layer.

In general, it may be said that for most satisfactory operation of the process of the present invention the barrier layer should have a thickness in the range of 50 to 600 A and more preferably in the range of 100 to 500 A (corresponding to an applied voltage of about 10 to 50 volts in the post-treatment stage). It may also be said that the colours with the most solid appearance result when the ratio of pore size (at the outer ends of the deposits) to cell size is high. Moreover, the intensity of colours obtainable greatly increases when the average deposit particle size is increased to 300 A and above.

In one anodising treatment for colouration in accordance with the invention a thick (15–25 microns) porous anodic oxide film was formed by anodising in 15% sulphuric acid at 20° C at a conventional anodising voltage in the range of 17–18 volts so as to produce a pore size in the typical 150–180 A range with corresponding cell size. The thus anodised aluminum was then subjected to electrolytic treatment in phosphoric acid under direct current conditions at various voltages in the range of 8 – 50 volts. It was found that in each case there was an initial rapid change in current density during which interval the thickness of the barrier layer became adjusted to a thickness appropriate to the applied voltage. The current density then becomes more or less constant during further processing, during which it is believed that an enlarged portion at the base of the pores becomes elongated by controlled dissolution or by new anodic film growth. At voltages below the original anodising voltage the pore widening is largely by dissolution. At higher voltages (above the film forming voltage), the increased pore size is due either partly or wholly to new film growth, depending on the applied voltage and the temperature of the electrolyte.

One very satisfactory post-treatment for producing pore enlargement by a combination of dissolution and new film growth in a thick (25 micron) anodic film, produced in sulphuric acid, in 4 – 15 minutes in phosphoric acid at a strength of 80 – 150 gms/liter, preferably 100 – 120 gms/litre at 17 – 25 volts and 20°– 30° C, for example 20 volts and 25° C. This results in an enlargement of the pore size at least at the inner end of the pore and the barrier layer remains at the same order of thickness as at the end of the sulphuric acid anodising operation.

The phosphoric acid electrolyte may include up to 50 gms/liter oxalic acid, for example 30 gms/litre, and in such case the electrolyte temperature may be raised to 35° C.

Under conditions in which film dissolution predominates over film growth (low voltage and/or high electrolyte temperature) dissolution will take place over the whole film and pore surfaces in addition to the field-assisted dissolution at the base of the pores. This bulk film dissolution can be measured by density changes.

The upper limit of a dissolution treatment designed to increase pore diameter is set by the point where the film loses strength and becomes powdery or crumbly through reduction of the thickness of oxide lying between adjacent pores. We have found that with a conventional sulphuric acid-anodised film where the initial density of the film is about 2.6 – 2.8 gms/cm$^3$, the film can be reduced to about 1.8 gms/cm$^3$ before the film starts to become powdery, although it is clearly desirable to minimize bulk film dissolution.

In the electrolytic colouring stage a wide range of colouring electrolytes with appropriately chosen colouring conditions can be used. Preferred electrolytes are based on tin, nickel or cobalt salts or mixtures of these salts and a wide range of electrical conditions have been used for performing the colouring operation. Electrolytes based on copper, silver, cadmium, iron and lead salts can also be used for producing interference colour effects. Copper is of some special interest because the resulting colours are different from those produced in nickel, tin or cobalt baths.

It has been found satisfactory to employ an a.c. supply giving an essentially sinusoidal voltage output, but the various types of biased or interrupted supply, or even direct current, that have been used for electrolytic colouring are likely to give similar interference effects. The colouring voltage must be selected so that the rate of deposition of inorganic pigmentary material is not too rapid so as to avoid excessive rapidity of colour change with treatment time. Actual values of colouring voltage, however, depend on the anodising and colouring conditions used.

EXAMPLE 1

An aluminium magnesium silicide alloy extrusion, 15 cm × 7.5 cm in size, was degreased in an inhibited alkaline cleaner, etched for 10 minutes in a 10% sodium hydroxide solution at 60° C, desmutted, and then anodised under direct current at 17 volts in a 165 g/liter sulphuric acid electrolyte for 30 minutes at a temperature of 20° C and a current density of 1.5 A/dm$^2$ to give an anodic film thickness of about 15 microns. This sample was then further anodised in 120 g/liter phosphoric acid and 30 g/liter oxalic acid solution for 8 minutes at 32° C and 25 volts direct current. This sample was then coloured under a.c. conditions in a tin-nickel solution of the following composition:

| | |
|---|---|
| $SnSO_4$ | 3 g/liter |
| $NiSO_4 . 7H_2O$ | 25 g/liter |
| Tartaric acid | 20 g/liter |
| $(NH_4)_2SO_4$ | 15 g/liter |

The pH of the solution was adjusted to 7.0 and nickel counter-electrodes were used.

The panel was coloured at 15 volts alternating current for times of 2, 3, 4, 6, 8, 12 and 16 minutes, the panel being raised slightly after each colouring period so that the whole range of colours was produced on the same panel. The panel was then sealed normally in boiling water. The colours on the panel were as follows:

| Colouring time in mins. | Colour |
|---|---|
| 2 | no significant colour |
| 3 | very light bronze |
| 4 | light bronze |
| 6 | mauve-grey |
| 8 | blue-grey |
| 12 | grey-green |
| 16 | purple-brown |

Of these colours those produced with between 3 and 16 minutes colouring time were of the interference type.

EXAMPLE 2

A panel was anodised in sulphuric acid as in Example 1 and, after anodising and rinsing, it was placed in a bath of 165 g/liter sulphuric acid at 40° C for 10 minutes without application of electrolytic action, so that enlargement of the pores was effected solely by chemical dissolution. It was thoroughly rinsed and then coloured for times of 1 to 16 minutes at 8 volts alternating current in a cobalt-based electrolyte having the following composition:

| | |
|---|---|
| $CoSO_4 . 7H_2O$ | 25 g/liter |
| $H_3BO_3$ | 25 g/liter |
| Tartaric acid | 2 g/liter |

The colours produced were as follows:

| Colouring time in min. | Colour |
|---|---|
| 1 | light mauve-grey |
| 2 | green-grey |
| 3 | golden yellow |
| 4 | orange-brown |
| 6 | brown |
| 8 | purple-brown |
| 12 | dark bronze |
| 16 | very dark bronze |

Of these colours those produced at times of up to 8 minutes were of the interference type.

EXAMPLE 3

An aluminium magnesium silicide alloy panel was anodised in sulphuric acid as described in Example 1 and was then subjected to a post-treatment for 12 minutes at 25 volts in an electrolyte containing 120 g/liter phosphoric and 30 g/liter oxalic acid mixture under direct current conditions at 30° C. It was then coloured in the cobalt salt bath and the colouring conditions of Example 2. Stainless steel counterelectrodes were employed. The panel was coloured for times of 1, 2, 3, 4, 6, 8, 12 and 16 minutes at 12 volts alternating current, giving the range of colours shown below:

| Colouring time in min. | Colour |
|---|---|
| 1 | very pale bronze |
| 2 | light bronze |
| 3 | grey-bronze |
| 4 | mauve-grey |
| 6 | green-grey |
| 8 | yellow-green |
| 12 | orange-brown |
| 16 | red-brown |

In this case all but the light colours (1 and 2 min. colouring) are caused by interference.

EXAMPLE 4

An aluminium magnesium silicide alloy was anodised in sulphuric acid as in Example 1 and was then treated for 10 minutes at 20 volts direct current in a 120 g/liter phosphoric acid electrolyte at 25° C. It was then coloured under a.c. conditions in the cobalt colouring electrolyte of Example 2. This was used at pH 6.0 with graphite counterelectrodes. Colouring was carried out for times of 4 to 28 minutes at 9 volts alternating current, producing the following range of colours:

| Colouring time in min. | Colour |
|---|---|
| 4 | bronze-grey |
| 6 | blue-grey |
| 8 | green-grey |
| 12 | yellow-green |
| 16 | orange-brown |
| 20 | red-brown |
| 24 | purple |
| 28 | deep bronze |

In this case the whole range of colours was probably of the interference type.

EXAMPLE 5

An aluminium magnesium silicide alloy panel was anodised in sulphuric acid as in Example 1 and was then treated in a 120 g/liter phosphoric acid electrolyte for 6 minutes at 25° C, using 10 volts direct current. It was then coloured in the cobalt colouring electrolyte of Example 3 for 1 to 16 minutes at 6 volts a.c., producing the following range of colours:

| Colouring time in min. | Colour |
|---|---|
| 1 | very light bronze |
| 2 | light golden brown |
| 3 | light purple-brown |
| 4 | blue |
| 6 | green-grey |
| 8 | yellow-brown |
| 12 | golden-brown |
| 16 | purple-brown |

The colours all involved interference and were the most intense or vivid of any of the Examples.

Where we have described the colours produced as resulting from interference effects, a clear indication that interference is the phenomenon involved can be obtained from the following experiment.

If a coloured sample, produced at process times by the methods described in the Examples stated to produce interference colours, is taken and the anodic coating is removed, without damage, from the aluminium substrate, and the coating is then viewed by transmitted light, the bright interference colours disappear and only a range of rather dull bronze is seen. By doing this, light scattering from the aluminium surface is eliminated and interference between this light and light scattered from the deposited material surface is no longer possible. Only the normal light scattering and absorption effects then occur. However, if a layer of aluminium is then re-deposited, by vacuum deposition, at the original oxide-aluminium interface the bright interference colours return. If the same operation is then done with a coating coloured by conventional electrolytic colouring techniques then the colour does not significantly change.

In the above description we have stressed the importance of depositing inorganic particles which at their outer ends have an average size of 260 A or more, for example 300 A or higher.

The examination of the film after electrocolouring, using electron microscopy, shows that the shape of the deposited inorganic particles is irregular and there is a wide range both of shapes and sizes of the particles. However, in films coloured by the process of the present invention (except when purely chemical dissolution is used), the diameter of the pores at a position midway through the film thickness is considerably smaller than the size of the particles lying in the enlarged base portion of the pore. It follows also that the significant measurements relating to this invention are to be made at the outer end of the deposit.

We have referred above to the improvement in the interference colours achieved when the average particle size is increased. When an anodic oxide film, coloured by the procedure of the present invention, is examined by electron microscopy, it is found that in addition to the enlarged pores there are still some pores (which may be empty or contain particles) of the size typical of the initial anodic oxide film before the pretreatment. It has already been shown that the intensity of light scattered by spherical particles of a diameter below the wavelength of light is proportional to $d^6/\lambda^4$, where $d$ is the particle diameter and $\lambda$ is the wavelength of the light. While the dispersive effect of the particles present in the coloured anodic oxide films of the present invention does not necessarily obey the same law, it will readily be apparent that small particles will have little effect.

In order to measure the average particle size of the particles, the film is sectioned at the level of the top of the particles and an electron microscope photograph at a suitable very high magnification (for example 60,000 – 120,000 times) is made. A random straight line is then drawn across the microphotograph. The maximum dimension in a direction parallel to the intercept line is then measured for each intercepted particle and the average particle size herein referred to is the average of the maximum dimensions of the particles as thus measured.

In preparing electron microscope photographs it is well known that very small errors in adjustment of the apparatus, such as slight tilting, lead to an apparent elongation of all the particles in a particular direction. This is readily observable and when this occurs the intercept line is drawn in a direction at right angles thereto.

Using this technique we have made measurements of the average particle size of particles deposited in a sulphuric acid anodic oxide film developed at 17 volts at 20° C, subjected to a post-treatment in phosphoric acid of 120 gms/liter strength under temperature and voltage conditions set out below and finally coloured in the cobalt electrolyte of Example 2 using alternating current at a voltage dependent upon the voltage employed in the post-treatment. The anodic oxide film was of a thickness of 3 microns and the particle sizes do not necessarily correspond to the particle sizes obtained when an anodic oxide film of 15–25 microns is subjected to the same treatments.

| Post-Treatment Voltage | Time | Temperature | Particle Size A |
|---|---|---|---|
| *10 | 1 | 25° C | 216 |
| 10 | 2 | " | 298 |
| 10 | 3 | " | 312 |
| 10 | 4 | " | 308 |
| 10 | 6 | " | 299 |
| 25 | 2 | " | 345 |
| 25 | 10 | " | 429 |
| *40 | 2 | " | 201 |
| 40 | 10 | " | 733 |

*No interference colours visible

For comparison with the above a measurement of the pore diameter in the mid-section of the film (above the level of the top of the particles) was made in the case of the 10 volt-2 minute and 25 volt-2 minute post-treatment. This showed an average pore diameter of 182 A and 255 A respectively, whereas in the initial film the average pore diameter was measured as 146 A. Thus, it will be seen that in phosphoric acid there is dissolution of the pore walls at both 10 volts and 25 volts at 25° C, but the field-assisted dissolution is preferential in the region of the pore base.

Figure 2:
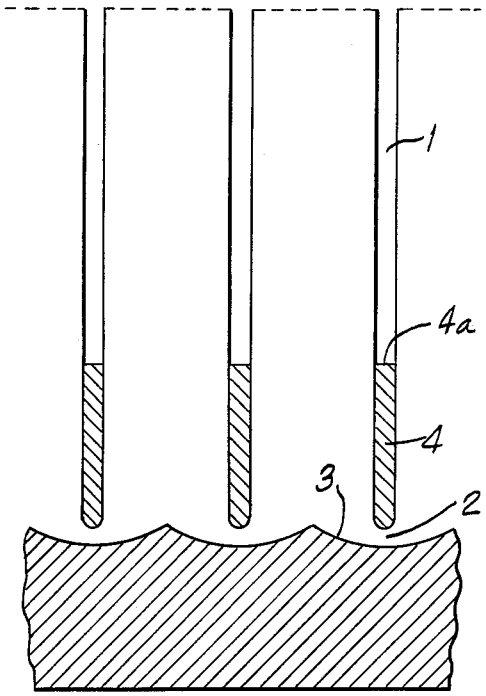

The accompanying FIGS. 1 and 2 illustrate what is believed to be the nature of a film coloured by the method of the present invention as opposed to a film coloured by the prior art electrocolouring process.

FIG. 2 shows a known sulphuric acid-type film, in which pores 1 are closely spaced and there is a barrier layer 2 between the base of the pores and the aluminium/aluminium oxide interface 3. In the electrocolouring process deposits 4 are deposited in the base of the pores and the vertical extent of these may be 1–8 microns ($1–8 \times 10^4$ A) and diameter about 150 A. The deposits 4 have end surfaces 4a of negligible light scattering power.

FIG. 1 shows in idealised form a film coloured by the method of the present invention, when a sulphuric acid-type film is subjected to a post-treatment which leads to preferential dissolution at the base of the pore. The pores now comprise an upper portion 1', which is of similar diameter to the original pore 1, and an enlarged lower portion 5. Depending on the voltage employed in the post-treatment, the barrier layer 2' may be thinner or thicker than the barrier layer 2.

In the enlarged pore portions 5 there are now deposited deposits 4', which are larger in size at their upper end surfaces 4'a than the deposits 4' (and therefore have very greatly augmented light scattering effect). The deposits 4' have very low vertical extent, so as to provide the interference colours as already stated. It will be understood that interference colours will not be present when the upper ends of the deposits 4 extend into the relatively narrow upper pore portion 1', since in that case their end faces would have a size similar to 4a. It is for that reason that the post-treatment must be continued for sufficient time to develop adequate enlargement of the pores at the level at which the end faces of the pigment deposits will be located.

In order to achieve the possibility of a wide range of interference colours, the post-treatment is continued for sufficient time and under appropriate conditions to ensure that the pore diameter is in excess of 260 A at all levels within the distance range of 500 – 3000 A from the aluminium/aluminium oxide interface.

The individual particles or deposits of inorganic pigmentary material are essentially homogeneous and effectively fill the base end of the pores in which they are deposited. They are thus different in nature from pigmentary particles which are deposited by electrophoresis. In particular, the electrolytically formed deposits are in most instances larger than the mid-section of the pores by reason of the enlargement of the inner ends of the pores.

We are aware that a process has already been described in Japanese Patent Applications Nos. 48-9658 and 49-067043 filed by Tahei Asada, in which aluminium, before electrocolouring, was first anodised in sulphuric acid and the anodising was continued in a phosphoric acid electrolyte. The described process was effective to produce grey-blue colours at short electrocolouring times. At longer electrocolouring times conventional bronzes and black were obtained. A full range of colours was not obtained by variation of the duration of the electrocolouring treatment. We have found that the average particle size of the deposit obtained by following the directions of the Japanese Patent Applications are less than 260 A. The grey-blue colour obtained is less bright and clear than is obtained by the procedure of the present invention and it is believed that the limited range of colours obtained is due to the fact that the described phosphoric acid second stage treatment leads to limited increase in pore size both in diameter and in length, as measured from the aluminium/aluminium oxide interface.

In relation to FIG. 1 the axial length of the enlarged pore portions was substantially below a value of 3000 A (from the aluminium/aluminium oxide interface).

We claim:

1. An aluminium article having a porous anodic oxide film on its surface, said porous anodic film having a thickness of at least 3 microns, the pores of said coating having inorganic pigmentary material deposited therein, characterized in that the average size of said deposits at their outer ends is at least 260 A and the separation between the outer ends of said deposits and the aluminium/aluminium oxide interface being in the range of 500 - 3000 A.

2. An aluminium article according to claim 1, further characterized in that the inorganic pigmentary material comprises at least one of cobalt, nickel, tin or copper, including oxides or hydroxides thereof.

3. An aluminum article having a porous anodic oxide coating on its surface, said porous anodic coating having a thickness of at least 3 microns and including a thin aluminum oxide barrier layer which is immediately adjacent to the aluminum surface, said coating having pores which extend from said barrier layer outward to the surface of the coating, said pores having an average width, at least at their base regions to a distance of 500 - 3000 A from the aluminum/aluminum oxide interface, which is at least 260 A, and said pores having inorganic pigmentary material deposited therein, the average size of said deposits at their outer ends being at least 260 A, and the separation between the outer ends of said deposits and the aluminum/aluminum oxide interface being in the range of 500 - 3000 A.

4. An aluminum article as defined in claim 3 wherein said average width of the pores and said average size of the deposits are each at least 300 A and said pores have said last-mentioned average width at least to a distance of 1500 A from the aluminum/aluminum oxide interface.

5. An aluminum article as defined in claim 3 wherein said pores have said average width at least to a distance of 3000 A from the aluminum/aluminum oxide interface.

6. An aluminum article as defined in claim 5 wherein the inorganic pigmentary material is metal-containing material in which the metal is one or more of tin, nickel, cobalt, copper, silver, cadmium, iron and lead and which includes the oxides or hydroxides thereof.

7. An aluminum article as defined in claim 3 wherein the inorganic pigmentary material is metal-containing material in which the metal is one or more of tin, nickel, cobalt, copper, silver, cadmium, iron and lead and which includes the oxides or hydroxides thereof.

8. An aluminum article as defined in claim 7 wherein said pores have said average width at least to a distance of 1500 A from the aluminum/aluminum oxide interface and wherein the size of the pores outwardly of the outer ends of said deposits is substantially smaller than the size of the deposits at their outer ends.

* * * * *

UNITED STATES PATENT AND TRADEMARK OFFICE

CERTIFICATE OF CORRECTION

PATENT NO. : 4,066,816

DATED : January 3, 1978

INVENTOR(S) : Peter Geoffrey Sheasby and Graham Cheetham

It is certified that error appears in the above-identified patent and that said Letters Patent are hereby corrected as shown below:

Column 1, line 39, "adsorption" should read -- absorption --.

Column 2, line 5, "form" should read -- for --.

Column 2, line 59, "interference" should read -- interface --.

Column 3, line 15, "botton" should read -- bottom --.

Column 3, line 60, "in" second occurrence should read -- is --.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*